United States Patent [19]

Coulston et al.

[11] 4,377,926

[45] Mar. 29, 1983

[54] FRAMING MEMBER FOR CURTAIN WALL STRUCTURES

[75] Inventors: Ellwin L. Coulston; S. Eugene Hubbard, both of Niles, Mich.

[73] Assignee: Kawneer Company, Inc., Niles, Mich.

[21] Appl. No.: 880,710

[22] Filed: Feb. 23, 1978

[51] Int. Cl.[3] ..... E04C 1/00

[52] U.S. Cl. ..... 52/309.3; 52/395; 52/403; 52/730; 48/DIG. 1

[58] Field of Search ..... 52/475, 403, 395, 235, 52/397, 398, 309.3, 730; 49/DIG. 1

[56] References Cited

U.S. PATENT DOCUMENTS

| | | | |
|---|---|---|---|
| 3,099,337 | 7/1963 | Hetman . | |
| 3,204,324 | 9/1965 | Nilsen | 52/309.3 X |
| 3,527,011 | 9/1970 | Bloom et al. | 52/398 |
| 3,978,629 | 9/1976 | Echols, Sr. | 52/395 X |
| 4,067,163 | 1/1978 | Hetman | 52/403 |
| 4,128,934 | 12/1978 | Doring | 52/730 X |

*Primary Examiner*—Carl D. Friedman

*Attorney, Agent, or Firm*—Mason, Kolehmainen, Rathburn & Wyss

[57] ABSTRACT

Vertical and/or horizontal frame members for use in a curtain wall construction including a framework and one or more glazing panels include a pair of elongated, spaced apart, metal elements structurally interconnected with a heat insulating element. One of the elements is formed with a pocket having an opening in a wall portion facing the other metal element and the other metal element includes a tongue extending into the pocket through the opening. The heat insulating element of resinous plastic material structurally interconnects the tongue and pocket of the metal elements into a composite frame member and provides a heat insulating thermal barrier therebetween.

3 Claims, 3 Drawing Figures

FRAMING MEMBER FOR CURTAIN WALL STRUCTURES

BACKGROUND OF THE INVENTION

1. Field of the Invention

The present invention relates to elongated frame members for use in curtain wall structures including a framework and one or more glazing panels. More particularly, the frame members of the present invention are adapted to provide a heat insulating thermal barrier between outside and inside elements of the framework and thereby reduce heat losses. The inside and outside elements of the frame members are formed of heat conductive extruded metal such as aluminum and the heat insulating thermal barrier is achieved by the use of rigid, heat insulating plastic resin material which structurally interconnects the inside and outside elements while providing a heat insulating thermal barrier therebetween. The frame members provide one or more glazing recesses for receiving marginal edge portions of glazing panels carried by a framework constructed of the frame members. The structural interconnection between the inside and outside elements of the frame members is designed so that these element are not likely to become detached even if the heat insulating material fails completely.

2. Description of the Prior Art

Because of the increasing costs of energy and a desire for reducing the heat loss through structural frame elements used for supporting glazing panels and the like, a variety of construction is disclosed and claimed in U.S. Pat. No. 3,204,324, issued Sept. 7, 1965. Another type of insulating frame member is disclosed in U.S. Pat. No. 3,729,354, issued Apr. 24, 1973 which patent is assigned to the same Assignee as the present application.

SUMMARY OF THE INVENTION

One of the principle problems in the development of heat insulated framing members wherein inside and outside metal elements are interconnected with a heat insulating material such as plastic resin and the like, is the concern that should the heat insulating material fail, the inside and outside elements may become structurally disconnected and thus unsuitable for use in buildings because of the safety problems resulting.

Another problem with various prior art heat insulated frame members is in providing the needed structural interconnection between the inside and outside metal elements while at the same time providing that good heat insulating characteristics between the elements in order to minimize heat losses.

It is an object of the present invention to provide a new and improved heat insulating frame member for use in curtain wall structures wherein a framework is provided for supporting one or more glazing panels.

More particularly, it is an object of the present invention to provide a novel frame member of the character described which provides a high strength heat insulating thermal barrier between inside and outside metal elements.

Still another object of the invention is to provide a new and improved frame member of the character described wherein improved structural integrity is developed between the inside and outside metal elements which elements are preferably formed of extruded aluminum.

Still another object of the invention is to provide a novel frame member of the character described which employs a heat insulating plastic resin material in a unique manner for thermally insulating between the inside and outside metal elements and which provides a novel structural interconnection which minimizes the chances of structural detachment between the inner and outer elements should the insulation fail under stress.

Yet another object of the present invention is to provide a new and improved frame member of the character described having a fail-safe structural interconnection between the inside and outside metal elements which are joined by a heat insulating plastic resin material.

Yet another object of the present invention is to provide a new and improved frame member of the character described which eliminates or greatly reduces the possibility of structural disconnection between inside and outside elements when the interconnecting heat insulating material fails.

Another object of the invention is to provide a new and improved heat insulating frame member of the character described which is economical to produce, relatively easy and rapid in erection and which provides an improved appearance in addition to the excellent heat insulating and structural characteristics.

Still another object of the present invention is to provide a new and improved fail-safe heat insulating frame member which greatly facilitates the rapid erection and fabrication of a curtain wall framework as well as the glazing thereof.

Yet another object of the invention is to provide a new and improved heat insulating composite frame member of the character described wherein the heat insulating element is positioned only on one side of the glazing panels supported on the frame member.

Still another object of the invention is to provide a new and improved heat insulating frame member of the character described wherein the heat insulating element is remote from the edges of the glazing panels whereby a relatively narrow face width may be provided.

Yet another object of the present invention is to provide a new and improved heat insulating frame member of the character described which utilizes a poured-in-place heat insulating element yet which does not require debridging or removal of any metal structure to effect a good thermal barrier.

Yet another object of the present invention is to provide a new and improved heat insulating frame member of the character described having a novel interconnecting structure between a pair of metal elements and a heat insulating element and improved surface bonding between these elements.

The foregoing and other objects and advantages of the present invention are accomplished in a preferred embodiment by way of illustration and not limitation, which embodiment comprises a novel frame member for use in a curtain wall or window framework for supporting one or more glazing panels. The frame member comprises a pair of spaced apart, elongated, metal elements forming one or more laterally disposed glazing recesses and one of the elements includes a pocket having an opening facing the other element. The other element includes a tongue extending into the pocket through the opening and the tongue forms a wall of the glazing recess. A heat insulating element is provided in the pocket around the tongue and structurally interconnects the metal elements to form a composite frame member. This heat insulating element provides a thermal break or barrier between the metal elements and structurally maintains the elements in heat insulated spaced apart relation. The thermal break is remote from the edges of the glazing panels and on one side thereof to provide the frame member with a narrow face width or sight line.

BRIEF DESCRIPTION OF THE DRAWINGS

For a better understanding of the invention, reference should be had to the following detailed description taken in conjunction with the drawings, in which.

DESCRIPTION OF THE PREFERRED EMBODIMENT

Figure 1:
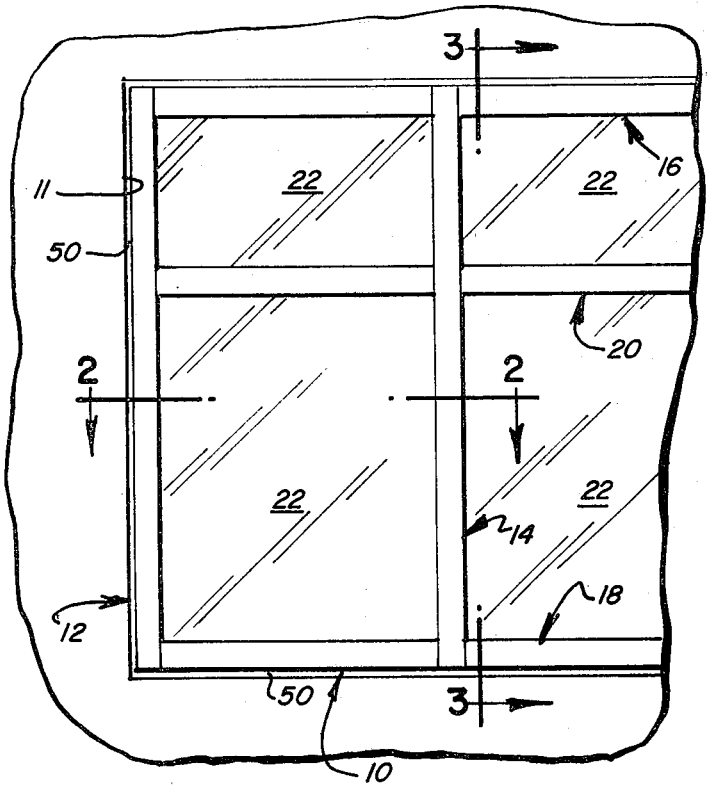
FIG. 1 is an elevational view of a curtain wall structure employing a framework of novel frame members in accordance with the features of the present invention.
Figure 2:
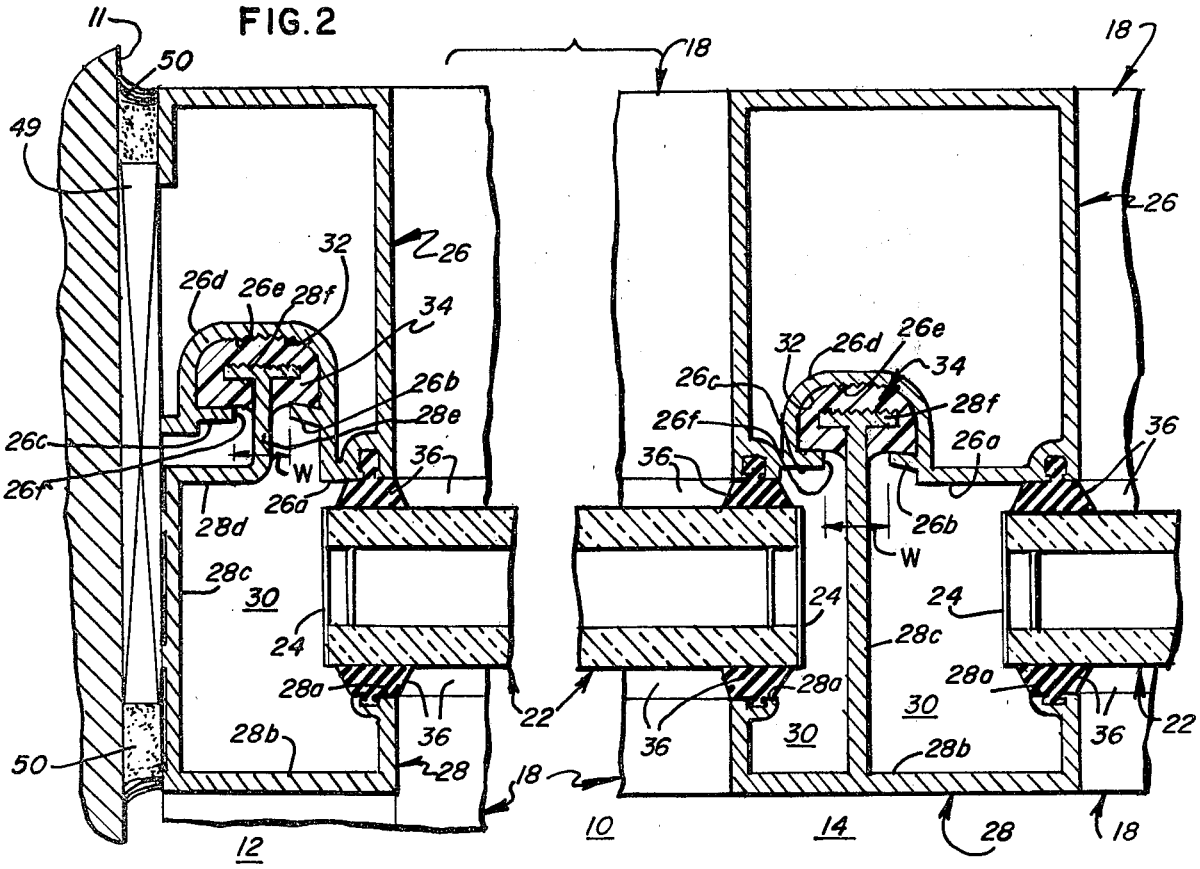
FIG. 2 is a horizontal, enlarged, sectional view taken substantially along lines 2—2 of FIG. 1.

Referring now more particularly to the drawings, in FIG. 1 is illustrated a new and improved curtain wall structure referred to generally by the reference numeral 10 and adapted to enclose a rectangular opening 11 in a building wall. The curtain wall includes a rectangular framework comprising vertical and horizontal members and a vertical jamb 12 is positioned adjacent one side of the opening with one or more parallel vertical mullions 14 spaced apart therefrom. The vertical members of the framework are interconnected adjacent their upper and lower ends and at an intermediate level by a horizontally extending head 16, a sill 18 and an intermediate horizontal or muntin 20.

The frame members provide support for a plurality of rectangular shaped glazing panels 22 preferably of the type including dual glass panels separated by a dead air space therebetween and trimmed around the peripheral edge with a continuous sealing and spacer strip 24. The double thickness glazing panels 22 provide for reduced heat flow between the interior and exterior of a building in comparison to single thickness glazing panels commonly in use. Accordingly, it is desirable to minimize heat transfer through the supporting metal frame members and for this reason, new types of frame members having a thermal barrier or heat insulator between the inside and outside have been developed.

In accordance with the present invention, the vertical jamb 12 includes an inside, metal element 26 having an outwardly facing wall with outer wall portions **26*a*, 26*b* and 26*c* generally facing an outside metal element 28. The outside metal element includes an outer wall having inwardly facing wall portions 28*a* and 28*b* with an inwardly directed tongue portion 28*c* extending inwardly toward the inside element 26. The wall portions 26*a* and 28*a* for opposite sidewalls of a glazing recess 30 for receiving the marginal edge portion of a glazing panel 22 and an inwardly extending tongue 28*c*** forms a bottom wall of the glazing recess extending between the opposite sidewalls thereof.

Along an inner edge, the tongue **28*c* includes a laterally offset portion 28*d* parallel of the outer wall 28*b* and an inwardly directed inside tongue segment 28*e* which projects into the inside structural element 26 between facing opposite edges 26*f* of the wall portion 26*b* and 26*c* which define a continuous elongated slot or opening having a width "W". Along the inner edge, the inside segment 28*e* of the tongue is formed with a right angle, laterally extending flange 28*f* having a width greater than the distance "W" between opposite facing edges of the wall portions 26*b* and 26*c*. The wall portions 26*b* and 26*c* of the inside metal element 26 are interconnected by a continuous, U-shaped wall portion 26*d* which forms an elongated concavely cross-sectional pocket 32 for receiving the tongue 28*e* and flange 28*f* of the outside metal element 28** in spaced apart relation as illustrated.

In accordance with the present invention, the pocket 32 is filled with a heat insulating element 34 of relatively rigid, resinous plastic material which provides a thermal barrier or insulating break between the inside metal element 26 and the outside metal element 28 of the jamb 12. The heat insulating material also provides structural interconnection between the metal elements to form the jamb 12 into a unitary frame member which can be cut and trimmed as one piece to any desired length. The heat insulating filling material 34 is introduced into the pocket 32 in a liquid state while the inside and outside elements 26 and 28 are firmly held in the relative position as shown. Subsequently, the plastic is cured, and solidifies into a rigid and strong heat insulating structural interconnection between the elements 26 and 28.

The metal elements are formed of extruded aluminum which has a much greater heat conductivity than the resinous plastic element 34 which provides a heat barrier and structural interconnection between the inside and outside elements. The cross-sectional shape of the heat insulating element is non-circular so that relative angular movement of the metal element is not likely to occur even if the surface bond between the metal and plastic should fail. The tongue flange **28*f* is wider than the width "W" of the opening in the pocket 32 between the wall portions 26*b* and 26*c* and if the filling material 34 should fail or deteriorate and become weakened, the size interference between the flange and the edges 26*f* of the opening virtually assures that the inside and outside elements 26 and 28 will not become structurally disconnected or separated. The interference or overlap between the facing outer edge portions of the flange 28*f* and the opposite edge portions of the wall segments 26*b* and 26*c* of the element 26 provides a fail-safe type framing member with excellent heat insulating characteristics and highly compatible with the dual pane glazing panels 22**.

The jamb 22 can be readily cut to length at the job site and is easily glazed with glazing strips 36 on opposite faces of the glazing panel supported in grooves provided in the opposite walk portions **26*a* and 28*a* of the glazing recess 30. The tongue 28*e* and flange 28*f* are substantially centered within the pocket 32 so that the heat insulating filling material 34 surrounds these portions with a substantially uniform thickness of material between the confronting surfaces of the elements 26 and 28 inside the pocket. The continuous wall 26*d* of the pocket is provided with a flat center portion 26*e* having ridges and grooves on the outwardly facing surface to provide for better bonding between the plastic fill material 34 and the aluminum and the tongue flange 28*f* may also have similar ridges and grooves facing and in parallel with the portion 26*e* to better improve the bonding between the plastic material and the aluminum. The result is an extremely strong and rigid structural interconnection between the inside and outside elements 26** and 28 of the jamb and the likelihood of physical failure of the insulating fill material 34 is minimized. However, should failure occur, the difference in widths between the tongue flange 28*f* and the opening "W" between opposite edges of the wall sections 26*b* and 26*c* almost entirely precludes the chance of structural disconnection between the inside element 26 and the outside element 28.

The vertical mullion 14 is generally similar in cross-section to the jamb 12 except that a pair of glazing recesses 30 are arranged in back to back, laterally disposed, oppositely outwardly facing directions in order to accommodate one or more pairs of glazing panels 22. Because the heat insulating element 34 is spaced remotely away from the edges of the glazing panels within the pocket 32 of the metal element 26, the glazing pockets may be separated by the relatively thin tongue 28*c* and this makes possible a relatively narrow mullion face width or sight line which is an architecturally desirable feature. In addition, the tongue 28*c* may be eccentric with respect to the center line of the mullion face 28*b* so that the respective glazing recesses are of different depths to facilitate the glazing process which can be carried on from inside the building structure if desired. The thermal break provided by the mullions 14 and jambs 12 is remote from the glazing plane on one side of the panels 22 and this is a desirable feature. It should be understood that the metal members 26 and 28 can be reversed in position so that the thermal break may be on the outside of the glazing panels rather than the inside. Moreover, if the elements 26 are positioned to the outside and the elements 28 on the inside of a building, a greater amount of face reveal may be provided.

Identical reference numerals are used in identifying the elements of the mullion 14 which correspond to similar or identical elements of the jamb 12 and only the major differences between the jamb and mullion will be described in detail. In contrast to the tongue 28*c* of the jamb 12, the tongue 28*c* of the outer metal element of the mullion 14 extends along a straight line into the center or mid section of the opening "W" without any lateral offsets. Again the laterally extending flange 28*f* has a width somewhat greater than the width "W" of the opening in order to provide the fail-safe feature previously described. The main body portion of the inside structural element 26 is generally tubular as illustrated with a pair of opposite, lateral side faces disposed in parallel to provide a smooth appearance on the inside surfaces of the curtain wall.

Apparatus for making the frame members 12, 14, 16, 18 and 20 and the process involved is described fully and in detail in the copending U.S. patent application Ser. No. 907,305, filed May 18, 1978, which application is assigned to the same Assignee as the present application and which application is incorporated herein by reference.

Figure 3:
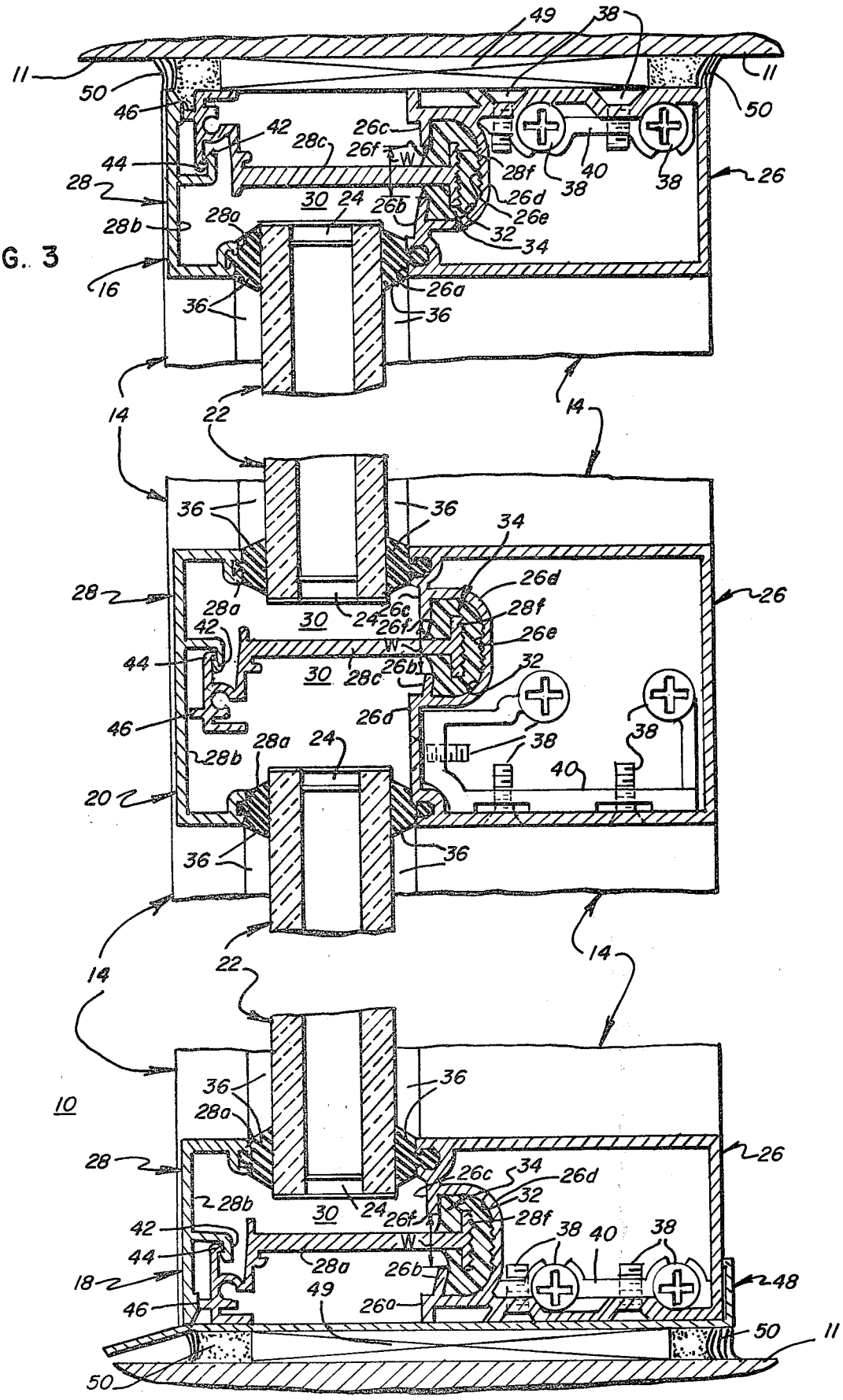
FIG. 3 is an enlarged, vertical, sectional view taken substantially along lines 3—3 of FIG. 1.

Referring now to FIG. 3, the horizontal frame members 16, 18 and 20 are cut to length to extend between the vertical members 12 and 14 and are secured in place and connected thereto by means of cap screws 38 or other fasteners which support and attach clip members 40 onto the lateral side faces of the inside elements 26 of the mullions 14 and jambs 12. The cap screws are threaded into the wall sections of the frame members and once the clips 40 are secured on the verticals 12 and 14, they provide support for the horizontal members 16, 18 and 20.

The inside and outside elements 26 and 28 of the horizontals are generally similar in structure and function to the inside and outside elements of the vertical frame members 12 and 14 and identical reference numerals will be utilized to refer to identical or similar elements. The intermediate horizontal member or muntin 20 is similar in cross-section to the mullion 14 and provides for a pair of back-to-back glazing recesses 30 separated from each other by the horizontal tongue 28*c* of an outer metal element 28. The head 16 and sill 18 are generally similar to the jamb 12 and only a single glazing recess 30 is provided by these frame members.

Another major difference between the outside metal element 28 of the vertical frame members 12 and 14 and the outside elements 28 of the horizontal frame members 16, 18 and 20 is that the latter may be formed in two separate pieces which are adapted to be interlocked together by a pair of interlocking ridges 42 and 44 on the respective outer wall portion 28*b* and the tongue 28*c*. In addition, the wall portion 28*b* and tongue 28*c* of each outside element 28 includes a pair of abutting surface areas indicated as 46 which are laterally offset from the interlocking ridges 44 and 42 and this provides support for the outer wall and the tongue to maintain a right angle interconnection therebetween.

The lower sill 18 is adapted to rest on a drip pan 48 of generally L-shaped, cross-section and the pan rests upon a shim 49 used for leveling the sill with respect to the floor of the opening 11 in the building wall. Similarly, shims 49 are provided between the upper head 16 and the upper edges of the opening 11 with shims 49 likewise being provided between the vertical jambs 12 and the adjacent vertical sides of the opening 11. Caulking material 50 is provided around the periphery of the entire supporting framework of the curtain wall 10 on both the inside and outside of the building to provide a weather tight seal.

From the foregoing it will be seen that the new and improved frame members 12, 14, 16, 18 and 20 constructed in accordance with the features of the present invention provide fail-safe unitary, insulating frame elements which are easy to erect and assemble and which provide a neatly appearing, heat efficient structural support system for glazing panels of a curtain wall.

Because the heat insulating element 34 which provides a thermal break between the metal elements 26 and 28 is remote from the edges of the glazing panels 22, a narrow mullion face or sight line is provided and the thermal barrier is positioned on one side or the other of the glazing plane of the wall structure. The novel pocket and tongue construction provides excellent strength and permits a poured-in-place insulating element to be used without requiring subsequent debridging or metal removal as in the prior art.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. An elongated, composite, structural, insulated frame member comprising:

a pair of elongated metal elements interconnected by an element of heat insulating material;

one of said metal elements including an elongated pocket having an opening facing the other metal element, the other of said metal elements including an elongated tongue extending into said pocket through said opening, and said heat insulating element comprising a solid, nonporous, hardened plastic material, self-bonded to and disposed between adjacent facing surfaces of said pocket and said tongue for structurally interconnecting said metal elements forming a composite insulating frame member, said other member including a wall member forming a wall for at least one glazing recess removably interconnected with said tongue.

2. The frame member of claim 1 wherein said wall member and said tongue include interlocking ridges adapted to maintain positive interlocking engagement therebetween.

3. The frame member of claim 2 wherein said wall member and said tongue include abutting portions spaced apart from said interlocking ridges for maintaining said wall member and tongue in a selected angular relation when said ridges are interlocked together.

* * * * *